United States Patent [19]

Sica

[11] Patent Number: 4,467,533

[45] Date of Patent: Aug. 28, 1984

[54] DEVICE FOR REMOVING LIQUID FROM A PAINTING ROLLER

[76] Inventor: Michel Sica, 53 Ave. du Consul Général, Nordling, 93190 Livry Gargan, France

[21] Appl. No.: 238,841

[22] Filed: Feb. 27, 1981

[30] Foreign Application Priority Data

Mar. 4, 1980 [FR] France ..... 80 04776

[51] Int. Cl.[3] ..... F26B 17/30; B08B 3/00

[52] U.S. Cl. ..... 34/58; 15/246; 206/361

[58] Field of Search ..... 15/306 R, 104.92, 245, 15/236 R, 246; 134/138, 139, 149; 34/58, 8, 59; 159/6 R; 222/410; 206/361; 68/213

[56] References Cited

U.S. PATENT DOCUMENTS

| | | | |
|---|---|---|---|
| 2,794,264 | 5/1951 | Scholtka | 34/58 |
| 3,393,412 | 7/1968 | Wrbican | 15/1 |
| 3,436,264 | 9/1969 | Allen | 34/58 |
| 3,623,179 | 11/1971 | Roth | 206/361 |
| 4,162,552 | 7/1979 | Winter | 15/104.92 |
| 4,171,167 | 10/1979 | Swartwout | 15/104.92 |

*Primary Examiner*—Philip R. Coe
*Assistant Examiner*—Michael Knick

[57] ABSTRACT

The device comprises a tubular container having a closed end and an opening at the opposite end. The roller is inserted in the container by way of this opening. The container has internally spacer elements capable of receiving the roller in a position spaced from the inner surface of the tubular wall of the container and rendering the container connected to the roller for rotation with the latter. There is at least one outer cylindrical rolling surface on the container. For removing liquid from the roller, the latter is placed in the container and the assembly comprising the container and the roller is rapidly rolled on a surface so that the mixture of water and paint is ejected from the roller by centrifugal force and received in the container.

13 Claims, 3 Drawing Figures

1
2
3
4
5
6
7a
7b
11
13
14
15
15
2
2

2
7a
7b
8a
8b
12
13

A
A
1a
1b
2
7a
7b
8a
8b
9
10
11
11
11
11
12
16
17
1
1

DEVICE FOR REMOVING LIQUID FROM A PAINTING ROLLER

DESCRIPTION

The present invention relates to a device for removing liquid from a painting roller.

Painting rollers employed in the building industry or like industries may be cleaned after use with water or with special products of the white spirits type or the like, depending on the type of paint employed. However, this cleaning operation is long and fastidious and the special products concerned are relatively expensive so that usually the rollers are cleaned only when the painting work has been finished. Consequently, the paint in the rollers must be prevented from drying, when, in the course of the work, these rollers are temporarily out of use, for example during the night, and for this prupose it is common practice to simply immerse them in water. It will be understood that the rollers then become impregnated with water and the water must be removed when it is desired to use them again for painting. This operation is usually carried out by rolling the roller rapidly against a wall, but this presupposes that such a wall is available for this purpose and results in much splashing of droplets of water and paint on the person who handles the roller and on the floor and walls in the vicinity.

Various devices for expressing the paint from painting rollers are known most of which are of the type described for example in U.S. Pat. No. 3,707,740 in which there is provided an element in the shape of a dish whose bottom has an opening having a diameter just a little less than the diameter of the roller to be drained and in which the roller is inserted so that the latter is gripped as it passes through said opening and the product with which it is impregnated is expressed.

Another device described in British patent No. 793 180 operates on the same principle, the element having an opening through which the roller is inserted being formed by an open end of a container, the diameter of this open end being slightly less than the diameter of the roller so as to express the product with which the roller is impregnated, this product being received in the container. This container constitutes a kind of sheath whose volume is roughly equal to that of the roller and in which the latter can be moved longitudinally after having placed in the container a certain amount of cleaning product, such as a solvent.

The French certificate of addition No. 72 40 256 discloses an apparatus for cleaning and expressing liquid from painting rollers comprising a liquidtight enclosure, which is fixed in position and encloses a rotary cage in which there is disposed the roller which has previously been separated from its mount, and a mechanical driving device formed by a motor or a crank and adapted to be connected to the shaft of the roller so as to rotate the latter with the cage in the liquidtight enclosure.

This device is complicated and consequently expensive to manufacture and not convenient to use.

An object of the invention is to provide a liquid removing device for a painting roller which overcomes these drawbacks and yet is simple in construction and cheap.

The invention provides a device for removing liquid from or cleaning a painting roller of the type comprising a tubular container closed at one end and having at the other end an opening for inserting the roller in the container, wherein the container has a diameter exceeding the diameter of the roller and includes internally spacer elements for receiving the roller in a position spaced from the inner surface of the tubular wall of the container and rendering said container connected to the roller so as to rotate with the latter, and at least one outer cylindrical rolling surface.

Preferably, said spacer elements are elastically deformable and are formed by fins projecting from the inner surface of the tubular wall.

Further features and advantages of the invention will be apparent from the ensuing description of one embodiment of the invention which is given solely by way of example and illustrated in the accompanying drawings in which.

Figure 1:
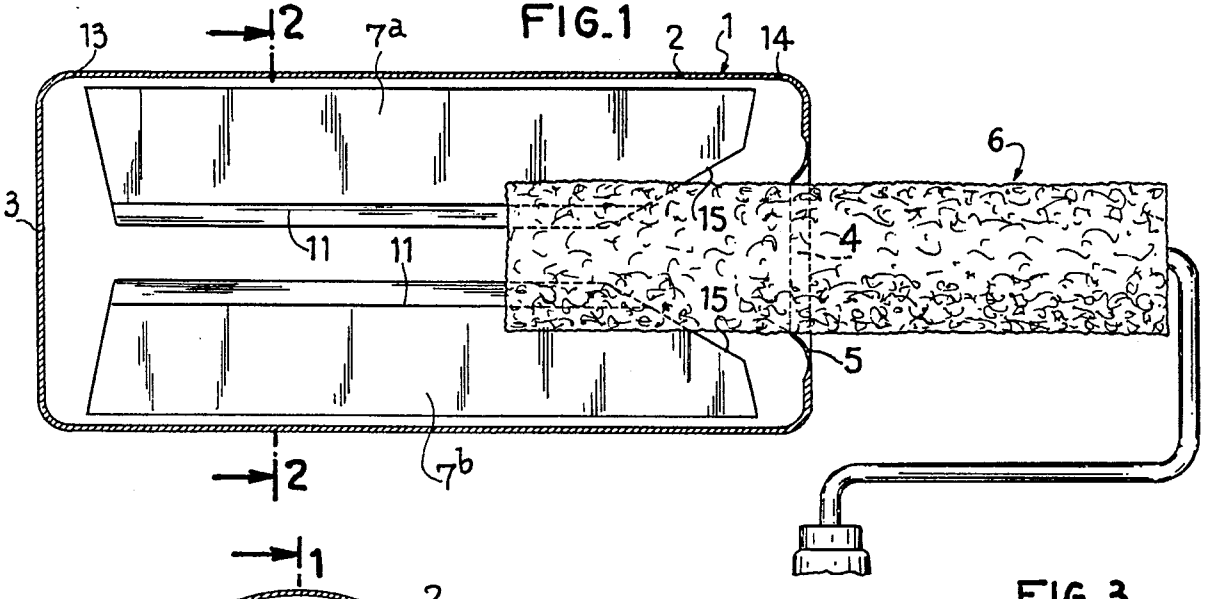
FIG. 1 is a longitudinal sectional view of a liquid removing device according to the invention in which a painting roller is partly engaged.
Figure 3:
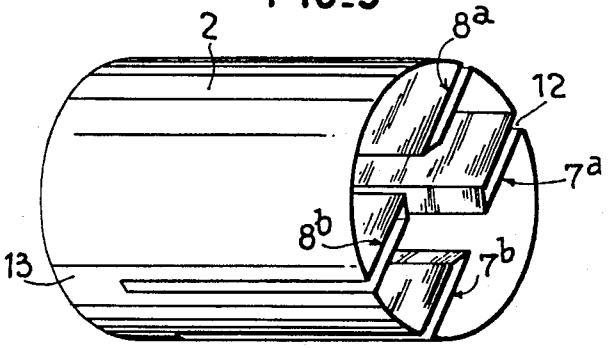
FIG. 3 is a perspective view of a device according to the invention assumed to be cut in the middle of its length so as to show the internal arrangement of the spacer pins therefor.

With reference to the drawing, the liquid removing device 1 shown comprises a tubular container having a cylindrical wall 2 closed at one end by an end wall 3 and having at its other end an opening 4 defined by a flange 5 and provided for the introduction of a painting roller 6 in the container 1. As shown, the flange 5 may be formed by a flexible circular lip whose inside diameter is less than or equal to the outside diameter of the roller 6 so as to permit a prior rough removal of the liquid from the roller 6 when it is inserted in the container 1. However, the presence of this flexible lip is not indispensable and the opening 4 may have a diameter exceeding the diameter of the roller 6 with which the container is adapted to be employed.

In a preferred embodiment of the invention, the container 1 comprises two half shells $1^a$ and $1^b$ of plastics material which are welded together in a joint plane A-A. Fins $7^a$, $8^a$ and $7^b$, $8^b$ are moulded hollow with each of the half shells $1^a$ and $1^b$ respectively. More precisely, each of the fins $7^a$, $8^a$, $7^b$ and $8^b$ consists of two walls 9 and 10 whose longitudinal edges are connected, at one end, to the cylindrical wall 2 of the container 1 and whose longitudinal edges at the other end of the fin are interconnected by a longitudinal edge portion 11 so that the walls 9, 10 of the fins, ensure the continuity of the cylindrical wall 2 and define internally a cavity 12 which opens onto the outer surface of the container 1. In view of the fact that the cylindrical wall 2 is interrupted in this way in a fraction of its periphery in the region of the fins the latter extend only in a part of the length of the cylindrical wall 2 so that the latter has adjacent its opposite ends regions 13 and 14 in which the wall 2 is uninterrupted so that the latter has the required rigidity imparted thereto and is not deformed when the container is rolled for the purpose of removing liquid from the roller 6. Further, the fins $7^a$, $8^a$ and $7^b$, $8^b$ each have at their end adjacent the opening 4 an oblique edge 15, the edges 15 defining guide surfaces for the roller which converge toward the centre of the container 1 from the open end of the latter.

Figure 2:
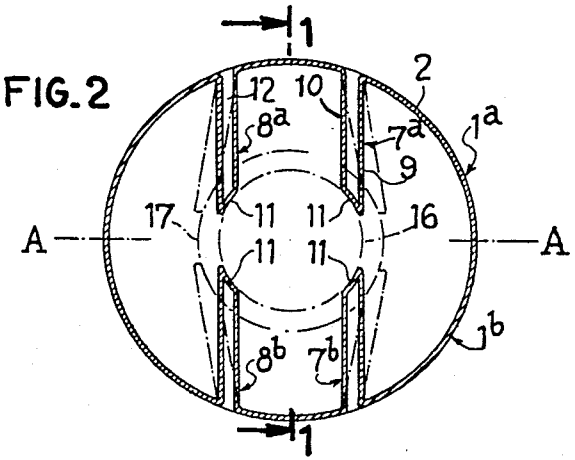
FIG. 2 is a sectional view taken on line 2—2 of FIG. 1.

As shown more particularly in FIG. 2, the four fins $7^a$, $8^a$, $7^b$ and $8^b$ are parallel in pairs and aligned in pairs, i.e. the fins $7^a$ and $8^a$, on one hand, and the fins $7^b$ and $8^b$ on the other are parallel to each other and the fin $7^a$ is in alignment with the fin $7^b$ and the fin $8^a$ is in alignment with the fin $8^b$. Further, the longitudinal edge portions 11 by which the fins bear against the roller from which liquid is to be removed may be planar or curved and are disposed substantially along arcs of the same circumference 16 centered on the axis of the container 1. The fins $7^a$, $8^a$, $7^b$ and $8^b$ are made from a material which enables these fins to be elastically deformed between an undeformed position shown in full lines in FIG. 2, in which the circmference 16 has a diameter less than the outside diameter of the roller from which liquid must be removed, and a deformed position shown in dot-dash lines, in which the longitudinal edge portions 11 bear against the outer circumference 17 whose diameter exceeds the diameter of the circumference 16 of this roller. Owing to this possibility of elastic deformation of the fins, the device for removing liquid just described may be employed with rollers of different outside diameters. The convergent edges 15 however permit an easy introduction of a roller in the container 1 irrespective of its outside diameter. It will be understood that the length of the container 1 must be adapted to the length of the rollers 6 from which liquid is to be removed so that these rollers can be wholly received inside the container 1.

The container 1 is preferably made from a watertight material so that it can be used as a pot for immersing the roller in water during the periods during which the roller is not in use. For this purpose, the roller is inserted until it is completely housed within the container and then, with the latter placed upright on its end wall 3, it is filled with water up to its upper edge. When the roller is desired to be used again for painting, the water is emptied from the container and then the container is rolled rapidly in one direction and the other against any planar surface available while holding the assembly comprising the container and the roller by the handle of the latter. Owing to the fact that the fins $7^a$, $7^b$, $8^a$ and $8^b$ grip or surround the roller 6, the latter is driven in rotation with the container and the water it contains is expelled or ejected under the effect of centrifugal force and is received inside the container without possibility of any splashing outside the container. The mixture of water and paint thus collected within the container is then emptied by way of the opening 4 and the operation is repeated if required.

It will be clear from the foregoing description that the device according to the invention is particularly easy to use and its construction is cheap since it may be manufactured by moulding a plastics material.

While a single embodiment has been described hereinbefore, it must be understood that many modifications may be made therein as concerns for example the shape and disposition of the spacer devices, the material of the latter and of the container, the manner of producing the latter and so on, without departing from the scope of the invention defined in the claims.

For example, the container may have on its outer surface means having a high coefficient of friction, for example collars of rubber or the like which ensure that the container does not slip on the surface along which it is rolled.

Having now described my invention what I claim as new and desire to secure by Letters Patent is:

1. A device for removing liquid from a painting roller comprising a tubular container having a tubular wall, a closed end and defining at an end opposed to said closed end an opening for inserting said roller in the container, internal spacer elements attached to and inwardly extending from the tubular wall and oppositely disposed in spaced relation to each other for receiving in the space between opposite spacer elements said roller in a position of the roller spaced from the tubular wall and for gripping the roller and drivingly connecting the container to the roller, and an outer cylindrical rolling surface carried by the tubular wall whereby the liquid can be removed from the roller under the effect of centrifugal force by rolling the rolling surface of the container containing the roller along a surface.

2. A device according to claim 1, wherein said spacer elements are elastically deformable.

3. A device according to claim 1, wherein said spacer elements are formed by fins which project inwardly from said tubular wall.

4. A device according to claim 3, wherein said spacer elements are elastically deformable.

5. A device according to claim 3, wherein said fins extend longitudinally of the container.

6. A device according to claim 5, wherein said fins each have an oblique edge at an end thereof adjacent said opening, said oblique edges defining roller guiding surfaces which converge toward the centre of the container from said opening of the container.

7. A device according to claim 5 or 6, comprising two pairs of fins which are parallel in pairs and in alignment in pairs.

8. A device according to any one of the claims 3 to 6, wherein said fins have longitudinal edges which are planar or curved and bear against said roller, and are disposed substantially on arcs of a circle of the same circumference.

9. A device according to any one of the claims 3 to 6, wherein said fins have longitudinally extending edge surfaces for bearing against said roller and disposed on arcs of a common circle.

10. A device according to any one of the claims 3 to 6, wherein said fins are moulded with said tubular wall and are hollow and extend in a fraction of the length of the tubular wall.

11. A device according to any one of the claims 1 to 6, wherein said tubular wall has a cylindrical outer surface constituting said rolling surface, said outer surface being provided with means having a high coefficient of friction.

12. A device according to any one of the claims 1 to 6, wherein a flexible circular lip defines said opening which has a diameter at the most equal to the outside diameter of said roller.

13. A device according to claim 8, wherein said edge surfaces are curved in transverse planes perpendicular to the longitudinal direction of the tubular wall.

* * * * *